US011091291B2

(12) United States Patent
Kellerer

(10) Patent No.: US 11,091,291 B2
(45) Date of Patent: Aug. 17, 2021

(54) BOX WITH FOLDABLE SIDE WALLS AND LOCKING MECHANISM IN THE RIM

(71) Applicant: IFCO Systems GmbH, Pullach (DE)

(72) Inventor: Richard Kellerer, Feldkirchen (DE)

(73) Assignee: IFCO Systems GmbH, Pullach (DE)

( * ) Notice: Subject to any disclaimer, the term of this patent is extended or adjusted under 35 U.S.C. 154(b) by 0 days.

(21) Appl. No.: 16/586,065

(22) Filed: Sep. 27, 2019

(65) Prior Publication Data

US 2020/0024030 A1 Jan. 23, 2020

Related U.S. Application Data

(63) Continuation of application No. PCT/EP2018/000123, filed on Mar. 27, 2018.

(30) Foreign Application Priority Data

Mar. 28, 2017 (EP) ..... 17163354

(51) Int. Cl.
*B65D 6/18* (2006.01)

(52) U.S. Cl.
CPC ..... *B65D 11/1833* (2013.01)

(58) Field of Classification Search
CPC ..... B65D 11/1833; B65D 11/18; B65D 9/14; B65D 9/12; B65D 45/22; B65D 45/16; B65D 45/00
USPC ..... 220/6, 7, 4.28, 326, 324, 315, 318; 206/600; 217/16, 13, 12 R
See application file for complete search history.

(56) References Cited

U.S. PATENT DOCUMENTS 4,960,223 A * 10/1990 Chiang ..... B65D 11/1833 220/6
5,501,354 A * 3/1996 Stromberg ..... B65D 1/225 220/7
6,073,790 A * 6/2000 Umiker ..... B65D 11/1833 220/315
6,098,827 A * 8/2000 Overholt ..... B65D 11/1833 220/6
6,293,418 B1 9/2001 Ogden et al.
(Continued)

FOREIGN PATENT DOCUMENTS

DE 202008005791 U1 10/2008
DE 202011102591 11/2012
(Continued)

*Primary Examiner* — Robert J Hicks
(74) *Attorney, Agent, or Firm* — Michael A. Glenn; Perkins Coie LLP

(57) ABSTRACT

A foldable box includes a floor, two longitudinal-side and transverse-side exterior walls, and two lock elements having integrated rim areas. The longitudinal-side exterior walls extend a rim area at their free ends, respectively. The lock elements are arranged, at a free end of the transverse-side exterior walls, such that the integrated rim areas of the two lock elements of the transverse-side exterior walls and the two rim areas of the longitudinal-side exterior walls together form the rim of the foldable box in the folded-open state. The two lock elements of the transverse-side exterior walls are mounted to be moveable in relation to the transverse-side exterior walls to form a locking mechanism, wherein the two lock elements may be transferred from a respective locking state to a releasing state by a movement in a direction away from the floor.

19 Claims, 9 Drawing Sheets

(56) References Cited

U.S. PATENT DOCUMENTS

| | | | | |
|---|---|---|---|---|
| 7,059,489 | B2 * | 6/2006 | Apps | B65D 11/1833 220/6 |
| 7,641,066 | B2 * | 1/2010 | Baltz | B65D 11/1833 220/7 |
| 2005/0098556 | A1 * | 5/2005 | Kellerer | B65D 11/1833 220/7 |
| 2007/0145053 | A1 * | 6/2007 | Escarpa Gil | B65D 11/1833 220/7 |
| 2011/0174809 | A1 * | 7/2011 | Dubois | B65D 11/1833 220/4.28 |
| 2011/0259884 | A1 * | 10/2011 | Kellerer | B65D 11/1833 220/6 |

FOREIGN PATENT DOCUMENTS

| | | | | |
|---|---|---|---|---|
| EP | 2112080 | A1 | 10/2009 | |
| JP | 2009018827 | A | 1/2009 | |
| JP | 2009023669 | A | 2/2009 | |
| WO | WO-2008025393 | A1 * | 3/2008 | B65D 11/1833 |
| WO | 2009050689 | A1 | 4/2009 | |
| WO | WO-2011085953 | A1 * | 7/2011 | B65D 19/18 |

* cited by examiner

BOX WITH FOLDABLE SIDE WALLS AND LOCKING MECHANISM IN THE RIM

CROSS-REFERENCES TO RELATED APPLICATIONS

This application is a continuation of copending International Application No. PCT/EP2018/000123, filed Mar. 27, 2018, which is incorporated herein by reference in its entirety, and additionally claims priority from European Application No. EP 17163354.8, filed Mar. 28, 2017, which is incorporated herein by reference in its entirety.

The present invention relates to easily transportable boxes whose side walls may be folded down for transport and which comprise, for this purpose, a locking mechanism integrated into a rim. Advantageous embodiments relate to a box comprising, e.g., a slat-structure design wherein the locking mechanism is configured as a separate lock element which at the same time forms the rim of the corresponding side wall.

BACKGROUND OF THE INVENTION

In the marketplace, a plurality of foldable boxes, or foldable crates, are available which consist of a bottom (or floor) and side walls which are foldable with respect to the floor, so that the boxes may be folded after use by folding down their side walls in order to be able to be transported back to the location of their renewed use in a space-saving and cost-efficient manner.

Since such foldable boxes are used industrially on a large scale and for many different purposes, for example to transport fruit or vegetables from the harvest fields to the consumers, such a foldable box has to meet many different requirements which partially influence one other. Some requirements result from the aspect of transportability. For example, it is especially desirable for the box to have a low stacking height in the folded-down state so that during transport, as large a number of folded-down boxes as possible may be transported on a pallet. Furthermore, the box should be as light as possible, i.e., as little material as possible should be used to keep the ratio between the loading capacity, or useful load, and the weight of the box to a minimum. Apart from this, since such boxes are frequently also used for transporting food, it is most useful for the interiors of the boxes to be as smooth as possible so that no food rests can get trapped inside the box. Simultaneously, the box should be stable, however, which makes the use of large, smooth planes difficult.

One further requirement relating, in particular, to ease of use when loading the goods, when cleaning the box and, above all, when presenting the goods when the box is positioned directly in the supermarket, is that the foldable exterior walls remain in a locked state (locking state) in a secure and reliable manner. To this end, so-called locking mechanisms have been used in conventional technology. Said locking mechanisms are provided, e.g., on the short exterior wall (transverse-side exterior wall). A locking mechanism from conventional technology comprises, e.g., three individual elements arranged on the exterior side of the exterior wall. Among said three exterior elements, two exterior elements are essentially identical and enable engagement into snap-in hooks, or snap-in noses, from the longitudinal-side walls (longitudinal-side exterior walls). Those two identical elements may be rotationally supported, for example, and are locked and unlocked by means of the third element of the locking mechanism, a so-called actuation lever. In particular when the box is to serve to directly present the goods in the retail trade, such mechanisms disturb the design.

As further conventional-technology examples of a locking mechanism, please refer to WO 2009/050689, U.S. Pat. No. 6,293,418, DE20 2011 102591, and EP 2 112 080. WO 2009/050689 shows a foldable box comprising two pairs of folding sides. As the locking mechanism, two folding sides have a pair of displaceable snap-in elements provided thereat which engage into the other folding sides. The displaceable snap-in elements are located on the exterior side, or exterior surface, of the folding sides. U.S. Pat. No. 6,293,418 also discloses a folding box comprising a comparable locking mechanism. DE 20 2011 102591 shows a folding container comprising a floor and four side walls pivotally hinged thereat. For locking purposes, one locking means is provided on the surface area of at least two opposite side walls in the area of the handle.

A further locking mechanism is disclosed in EP 2 112 080. Here, the lock is described as a U-profile which extends beyond the walls. Due to its shape and track of travel, however, the lock described herein restricts the freedom of design of the box, or of the side walls.

With the presentation boxes which are frequently encountered in conventional technology, the locking mechanism is at least partly shifted onto the interior side of the exterior wall (in the sense of the interior surface—which, however, entails the disadvantage that erroneous actuation of the locking mechanism by the goods might be possible. Therefore, there is a need for an approved approach.

SUMMARY

According to an embodiment, a foldable box including a rim may have: a floor; and two longitudinal-side and transverse-side exterior walls which are foldable in relation to the floor and are located opposite one another in pairs, respectively, and two lock elements having integrated rim areas; wherein the longitudinal-side and transverse-side exterior walls each include a hinge and a free end located opposite the hinge, the two longitudinal-side exterior walls each forming a rim area along the free end; wherein the two lock elements are arranged at the free ends of the transverse-side exterior walls such that the integrated rim areas of the two lock elements and the two rim areas of the longitudinal-side exterior walls form the rim in the folded-open state of the foldable box; wherein the two lock elements are mounted to be moveable in relation to the transverse-side exterior walls to form a locking mechanism, wherein the two lock elements may be transferred from a respective locking state to a releasing state by a movement in a direction away from the floor.

Embodiments of the present invention provide a foldable box comprising a floor and two longitudinal-side and transverse-side exterior walls located opposite one another in pairs, respectively, and foldable with respect to the floor. The four longitudinal-side and transverse-side exterior walls may be connected to the floor by means of hinges, for example. Said hinges each extend along a longitudinal edge of the longitudinal-side and transverse-side exterior walls, said longitudinal edge being referred to as hinge side below. The second side/end of the longitudinal-side and transverse-side exterior walls is free and is therefore referred to as the free end. A rim area is formed along the respectively free end of the two longitudinal-side exterior walls. With the transverse-side exterior walls, the rim area is not formed by the exterior walls themselves, but two so-called "lock elements comprising integrated rim areas" are provided on the transverse-side exterior walls, namely at the free ends thereof. These rim areas of the two lock elements form the rim of the foldable box together with the two rim areas of the longitudinal-side exterior walls in the folded-open state of the foldable box. Here, it shall also be noted that said lock elements are separated from the transverse-side exterior walls because they serve as the locking mechanism. To this end, the two lock elements are mounted to be movable in relation to the transverse-side exterior walls so as to be engaged with the adjacent side walls. In accordance with advantageous embodiments, said movable mounting is configured such that the two lock elements may be moved away from the floor (e.g., upward), in the folded-open state, in a direction vertical in relation to the surface of the floor, so as to transfer the lock elements (e.g., in the upward movement) from a locking state to a releasing state. Said implementation including the upward movement has two advantages, namely that—in the event that several boxes are stacked—the bottommost box is held in the locking state and that, therefore, the side wall may be manufactured with a closed visual appearance since no gaps are required for the unlocking movements.

Embodiments of the present invention are based on the finding that by providing those parts of the transverse-side exterior walls which are referred to as lock elements with integrated rim areas above, one provides the possibility of directly integrating the locking mechanism into an area of the exterior wall which blends into the design thereof. Providing the mechanics of the locking mechanism at the upper rim furthermore offers the advantage that the mechanics are not impaired by the goods transported within the box, and is also considerably easier to implement, which reduces product complexity and the manufacturing cost associated therewith. In accordance with an advantageous embodiment, this lock element (also referred to as a rim element) is configured in one piece and extends, e.g., across the entire width of the transverse-side exterior wall.

Viewed from a different side, this means that the lock element, which advantageously comprises a profile shape such as an L-profile or U-profile (which partially extends across the side) is not arranged on the face of the side wall (as in conventional technology) but is integrated into the rim, or rim area, of the box.

In accordance with further embodiments, the two lock elements are mounted to be sprung in relation to the transverse-side exterior wall by means of respective spring mechanisms which may advantageously, or by way of example, be integrated into the respective side walls, so that the spring mechanism moves the lock element into the locking state, or retains said locking state, by means of its spring force. In accordance with further embodiments, the lock element may also be opened counter to the spring force (releasing state), so that the lock element will snap back into the locking state as soon as no exterior force acts on same, and will snap-in here. In accordance with an embodiment, this locking mechanism may include snap-in noses provided on the longitudinal-side exterior walls and extending (in the folded-open state) towards the transverse-side exterior walls. Said snap-in noses are provided at the transverse-side ends of the longitudinal-side exterior walls and are configured to be engaged with snap-in elements which belong to the lock elements or are integrated into same, so as to lock the side wall. The snap-in elements extend (in the folded-open state) toward the longitudinal-side exterior walls and are provided at the ends of the lock elements. Due to the hook shape of the snap-in hooks, the lock element and, consequently, also the snap-in elements belonging to the lock element may be lifted above the hook by means of the releasing state so as to fold in the exterior wall. In accordance with a further embodiment, the snap-in hooks comprise inwardly directed contact surfaces which are bent such that the snap-in elements of the lock elements are transferred, when the transverse-side exterior wall is moved outward (e.g., against the contact surface), from a locking state of the lock element to a releasing state so as to then snap into the snap-in hooks. Here, this force applied by means of the chamfered contact surface may act counter to the spring force of the spring mechanism. Such an implementation offers the advantage that simple snapping of the exterior walls into the locking position is possible while the spring mechanism spring-mounts, or biases, the lock element so that same will be retained in the locking state.

With regard to supporting of the lock elements it shall be noted that their bearing may be implemented by grooves, for example, which extend transverse to the transverse-side exterior walls (i.e., vertically along the transverse-side exterior wall in the folded-open state). Said grooves guide the lock element during the movement from the locking state to the releasing state, and vice versa. In accordance with further embodiments, the grooves, or at least one of the grooves, may comprise so-called "end stops" in the direction of the floor and in the opposite direction, so that the vertical movement of the lock element is restricted.

In accordance with further embodiments, the transverse-side exterior walls and/or the longitudinal-side exterior walls form a slat structure comprising one or several slats, e.g., a wooden-slat structure. Such implementations are beneficial, in particular, for so-called "presentation boxes", by means of which the goods may be directly presented in the retail trade. Here, for example, the slats of the slat structure may extend longitudinally along the longitudinal-side and transverse-side exterior walls. One of the slats is imitated, in accordance with a further embodiment, by the lock element, so that said lock element fully blends into the exterior design. Here, it is advantageous for this slat of the lock element to be essentially the same in height, in relation to the transverse-side exterior wall, as the slat of the rim area, so that the design will also continue at the edges (/along the rim) of the foldable box. Here, "essentially" means, e.g., within a tolerance of ±1 mm or ±5 mm or, generally, within a range from 0 mm to ±5 mm.

It shall be noted at this point that in accordance with embodiments, the transverse-side exterior walls are designed to be lower (reduced height) as compared to the longitudinal-side exterior walls since the total height of the transverse-side exterior walls is defined by the combination of the lock element and the transverse-side exterior wall. In accordance with an advantageous embodiment, specifically, the lock element is located, in an encompassing manner, on the free end (on the side edge) of the transverse-side exterior wall. In other words, this means that the lock elements form, in the cross section, a bent profile (L or U), so that the lock elements may rest, with their integrated rim areas, on the free end of the transverse-side exterior walls so as to then terminate such that they are flush with the rim areas of the longitudinal-side exterior walls. Here, the locking element with its integrated rim area is located, in accordance with an advantageous variant, within the wall thickness, i.e., it does not jut out and thus forms a part of the side wall element.

In accordance with a further embodiment, the ends of the longitudinal-side exterior walls may have projections which limit foldability of the transverse-side exterior walls towards the outside.

In accordance with a further embodiment, each of the lock elements may comprise a manually actuable grip area which is advantageously arranged interiorly so as not to influence the exterior design via which the locking mechanism may be actuated. Said grip area may be a recess or a projection, for example, by means of which the lock element may be pulled upward so as to transfer it to the releasing state. The "upward" direction of movement offers the advantage that a further box which is stacked onto the actual box will retain the locking mechanism in the locking state.

In accordance with a further embodiment, the exterior wall comprises, e.g., below the lock element, a handle such as a recess, for example, by means of which the foldable box may be carried in the folded-open state. In order to prevent an error in operating the locking mechanism and/or the lock element, the handle is provided with a projection which extends along the associated lock element and shields it off, as it were.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
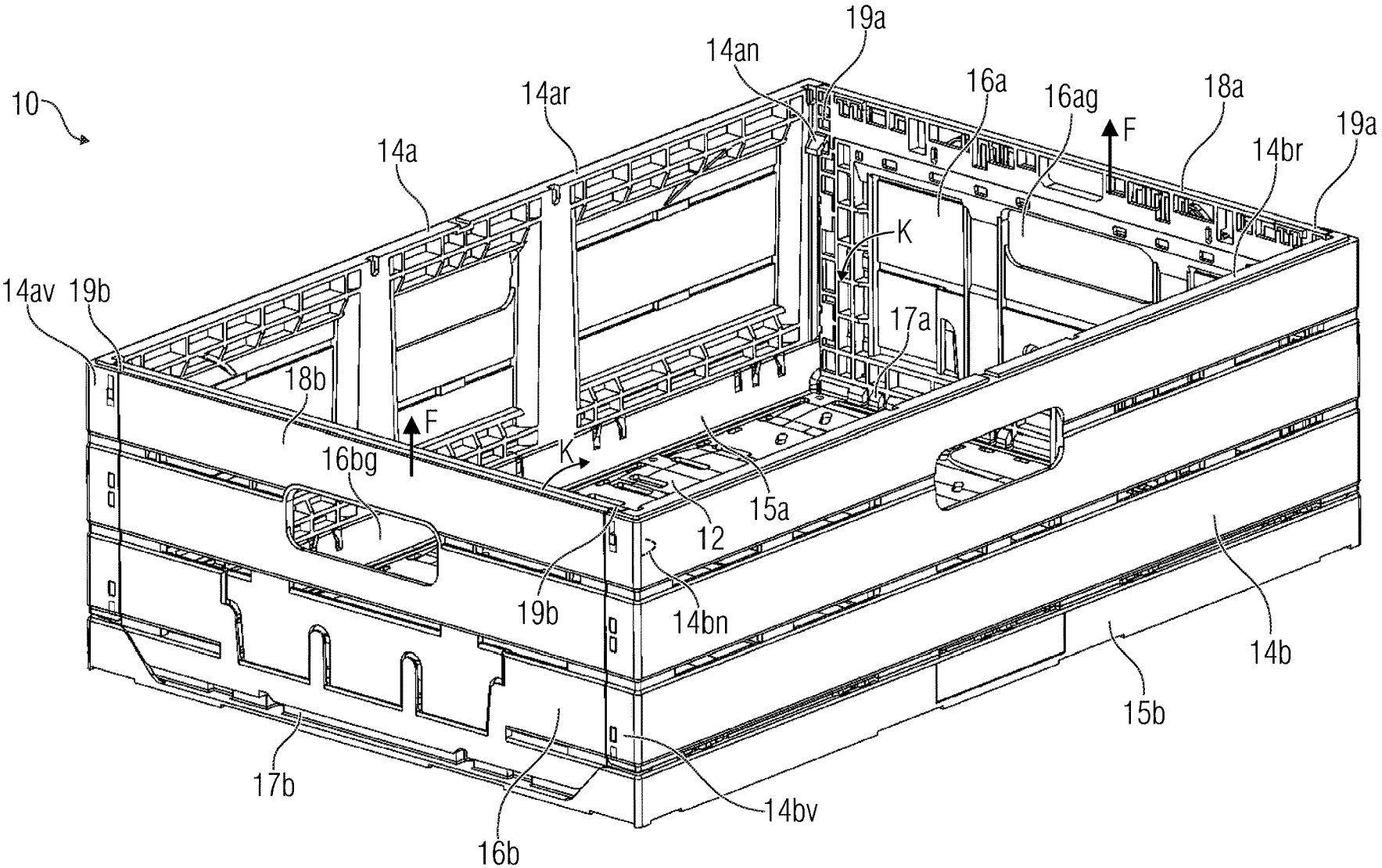
FIG. 1 shows a schematic representation of a foldable box in accordance with an embodiment.

Before embodiments of the present invention will be explained in detail below with reference to the figures, it shall be noted that elements and structures having identical actions have been provided with identical reference numerals, so that their descriptions are mutually applicable and/or exchangeable.

FIG. 1 shows a foldable box 10 comprising a floor 12, two longitudinal-side exterior walls 14*a* and 14*b* as well as two transverse-side exterior walls 16*a* and 16*b*. The longitudinal-side exterior walls 14*a* and 14*b* as well as the transverse-side exterior walls 16*a* and 16*b* are connected to the floor 12 via hinges, which here are marked by reference numerals 15*a*/15*b* for the hinges of the longitudinal-side exterior walls 14*a*/14*b* and by reference numerals 17*a*/17*b* for those of the transverse-side exterior walls 16*a*/16*b*.

In the discussion of the foldable box 10 which follows it shall be assumed that said box comprises the transverse-side exterior walls arranged in pairs (cf. reference numerals 16*a* and 16*b*) and the longitudinal-side exterior walls arranged in pairs (cf. reference numerals 14*a* and 14*b*). Pairwise occurrences of the reference numerals are indicated by the supplement "a" and/or "b". Said supplement in the reference numerals is also used, in the further reference numerals, for the further elements which may be associated with the respective exterior walls 14*a*, 14*b*, 16*a* and 16*b*, respectively, The longitudinal-side exterior walls 14*a*/14*b* comprise so-called rim areas 14*ar* and 14*br*, respectively. The rim area 14*ar* and 14*br*, respectively, extend along the longitudinal edge of the longitudinal-side exterior walls 14*a*/14*b*, i.e., along the free end of the side opposite to the hinges 15*a*/15*b*. With the transverse-side exterior walls 16*a*/16*b*, the rim is formed by so-called "lock elements" 18*ab* comprising an integrated rim area. The lock elements 18*a* and 18*b* extend along the free end of the transverse-side exterior walls 16*a* and 16*b* (opposite the hinges 17*a* and 17*b*). The lock elements 18*a* and 18*b* are fitted onto the exterior wall 16*a* and 16*b* such that the rim areas of the lock elements 18*a* and 18*b* along with the rim areas 14*ar* and 14*br* form the rim of the box 10. To this end, the respective lock element 18*a* and 18*b* may have a profile shape (L or U profile), so that it reaches around the free end of the corresponding transverse-side exterior wall 16*a*/16*b*. Here, advantageously, but not mandatorily, the longer leg of the profile is arranged along the exterior side.

The lock element 18*a* and 18*b* of the respective transverse-side exterior side 16*a* and 16*b* is separated from the exterior side and is mounted to be displaceable in the upward direction in relation to same (i.e., away from the floor 12). Advantageously, displacement of the lock elements 18*a* and 18*b* is effected as illustrated by the arrows F. Here, the direction of displacement F is selected such that the lock elements 18*a* and 18*b* are directed vertically upward in relation to the folded-open state of the box 10, starting from the floor 12. Said relative displacement of the lock elements 18*a* and 18*b* in the direction F enables implementing a locking mechanism which may form essentially two states, namely a locking state (depicted here) and a releasing state (in case of displacement in the F direction). The locking mechanism serves to lock the side walls 16*a* and 16*b* in relation to the side walls 14*a* and 14*b*.

In this embodiment, this locking mechanism is implemented in that the lock elements 18*a* and 18*b* engage—with respective snap-in elements, which here are marked by reference numeral 19*a* and 19*b*, respectively—into so-called "snap-in noses" 14*an* and 14*bn*, which belong to the longitudinal-side exterior walls 14*a* and 14*b*.

Thus, when the lock elements 18*a* and 18*b* are moved upward along the direction F, they will be disengaged from the snap-in noses 14*an* and 14*bn* (releasing state), so that the side walls 16*a* and 16*b* can be folded (while using the hinges 17*a* and 17*b*) onto the floor 12 in the direction of the arrows K. It shall also be noted at this point that due to said folding-in of the transverse-side exterior walls 16*a* and 16*b*, the longitudinal-side exterior walls 14*a* and 14*b* also will no longer be locked, so that they then may also be folded onto the floor 12 (while using the hinges 15*a* and 15*b*). This mechanism implements the foldability of the box. In accordance with an embodiment, the box 10 may imitate some kind of slat structure, as is depicted here as well, which comprises, for each exterior side 14*a*, 14*b*, 16*a*, and 16*b*, three slats, respectively, which extend longitudinally and are arranged one above the other. Said slats may imitate a wooden structure, even if they are made of plastic, for example, so that a wooden-design box may be implemented with the box 10 depicted here. With the transverse-side exterior walls 16*a* and 16*b*, the topmost slat, i.e., the slat at the free end of the transverse-side exterior wall 16*a* and 16*b*, is formed by the respective lock element 18*a* and 18*b*. This means, therefore, that the lock element 18*a* and 18*b* extends across the entire width of the transverse-side exterior wall 16*a* and 16*b* and blends into the slat structure design. In accordance with an embodiment, the heights of the slats are essentially identical both on the transverse- and on the longitudinal-side exterior walls, wherein "essentially" includes a certain tolerance range of up to 3 mm, 5 mm, or 8 mm. It is not mandatory for all slats to have the same height, but it is advantageous that at least the slats located at the rim or in the center or at the bottom (hinge side) have the same height, so that the slat-structure design continues accordingly.

Now that the fundamental concept of the foldable box 10 comprising mandatory and optional features has been explained with reference to FIG. 1, details and optional features will be discussed below with reference to FIGS. 2*a* to 2*d* and 3*a* to 3*d*.

Figure 2A:
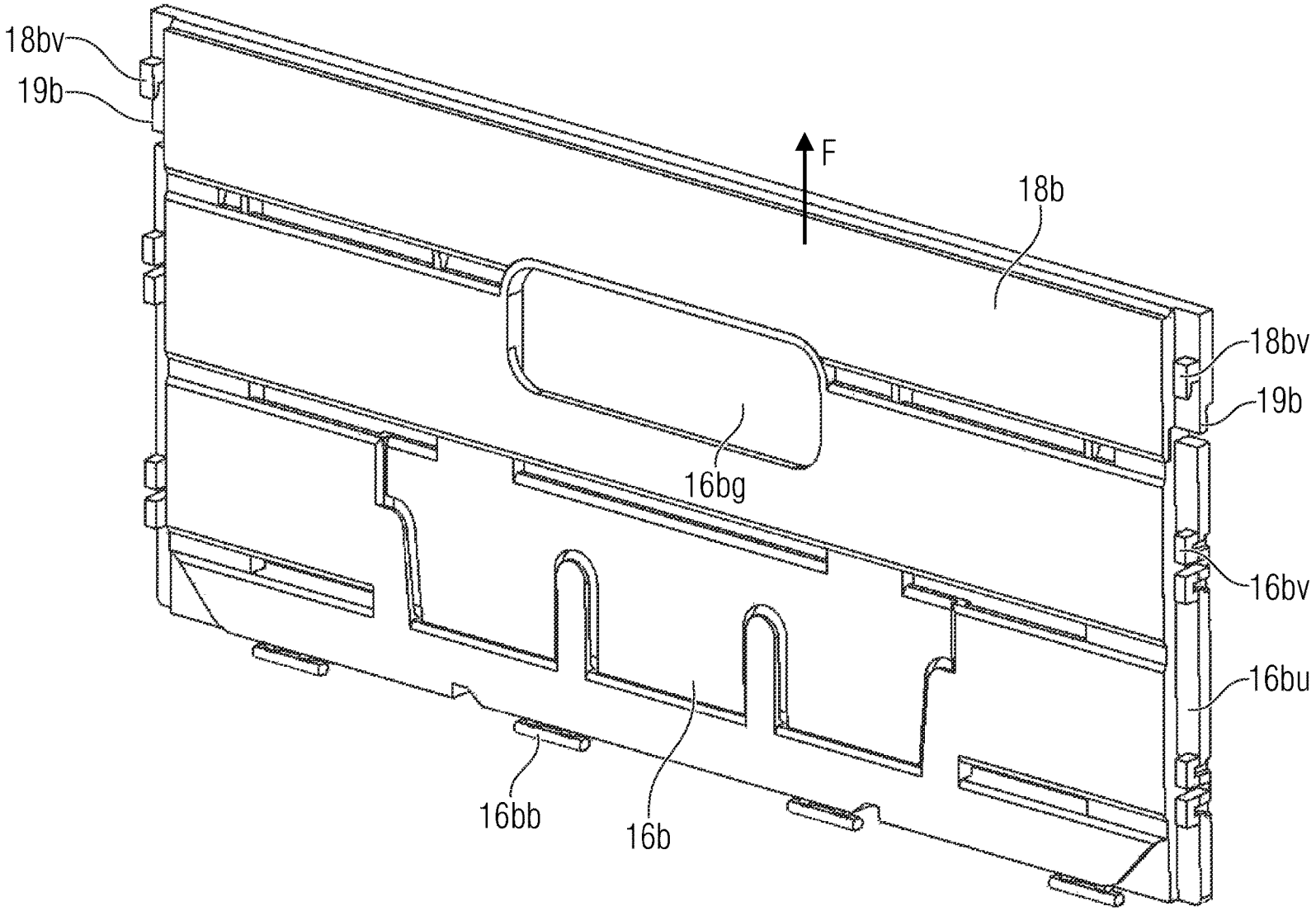
FIG. 2*a* shows a schematic representation of a transverse-side exterior wall comprising a lock element and a rim area integrated into same, of the box of FIG. 1 when viewed from outside.
Figure 2B:
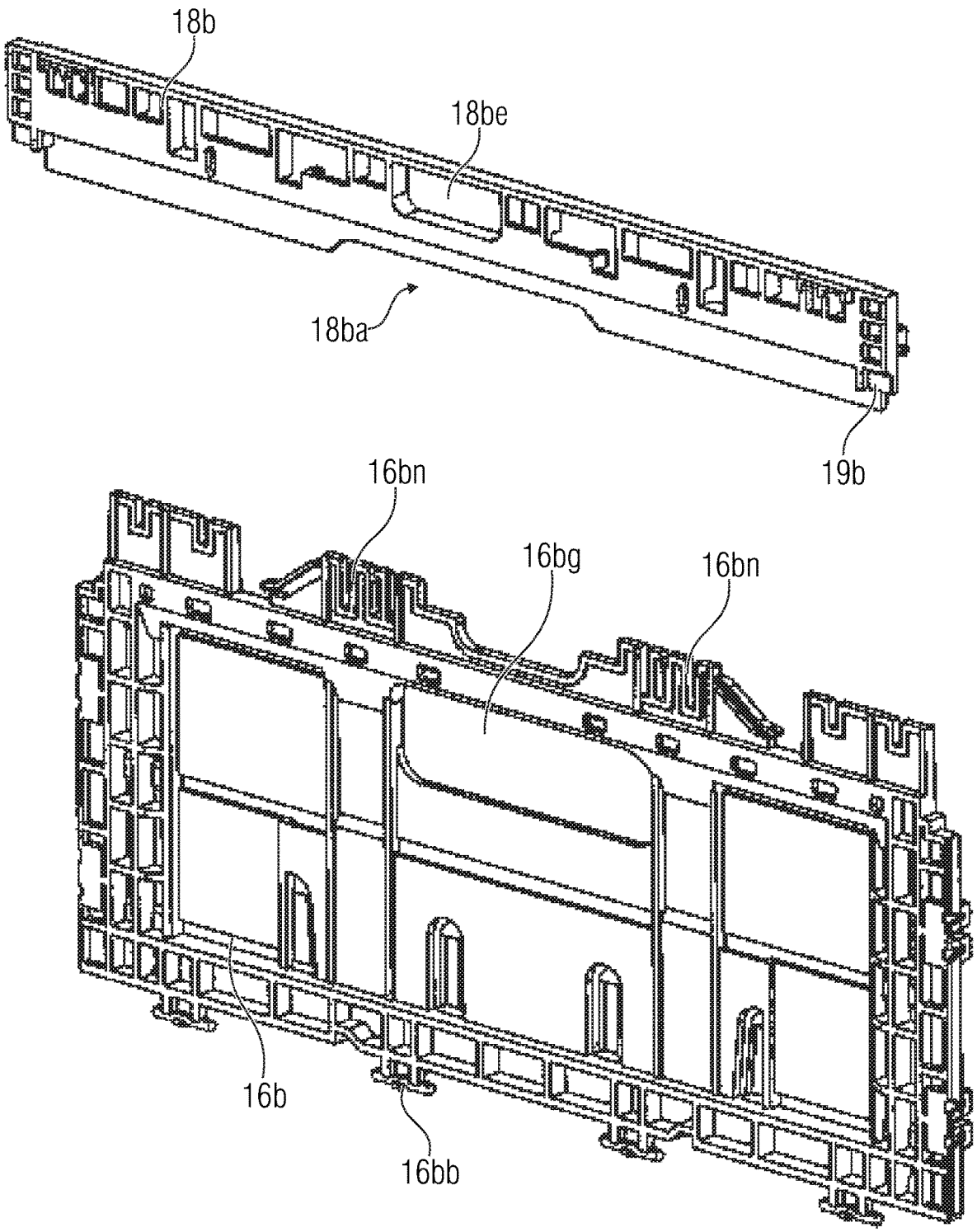
FIG. 2*b* shows an explanatory representation of the exterior wall of FIG. 2*a;*
Figure 2C:
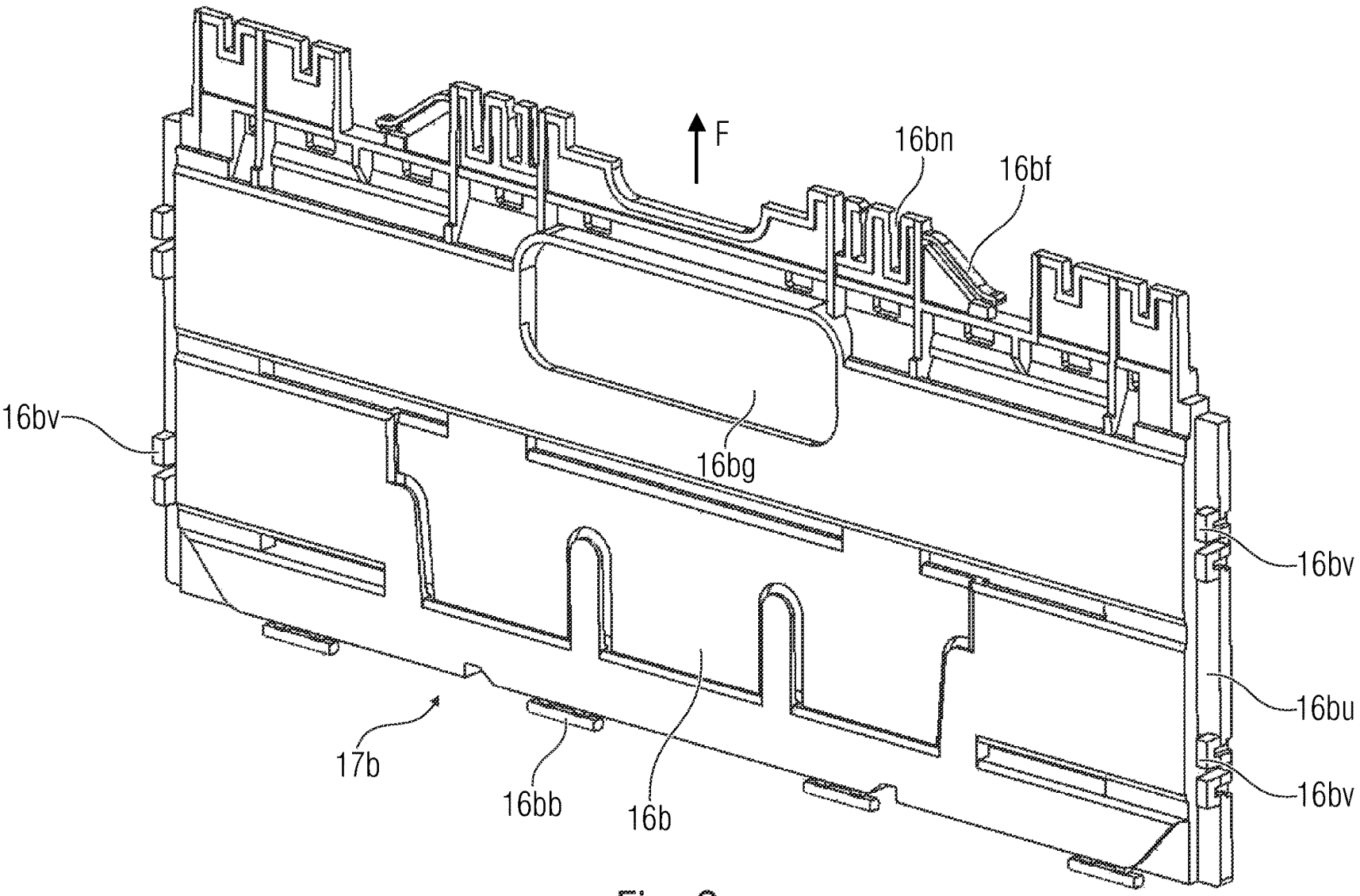
FIG. 2*c* shows a schematic representation of the exterior wall of FIG. 2*a;*
Figure 2D:
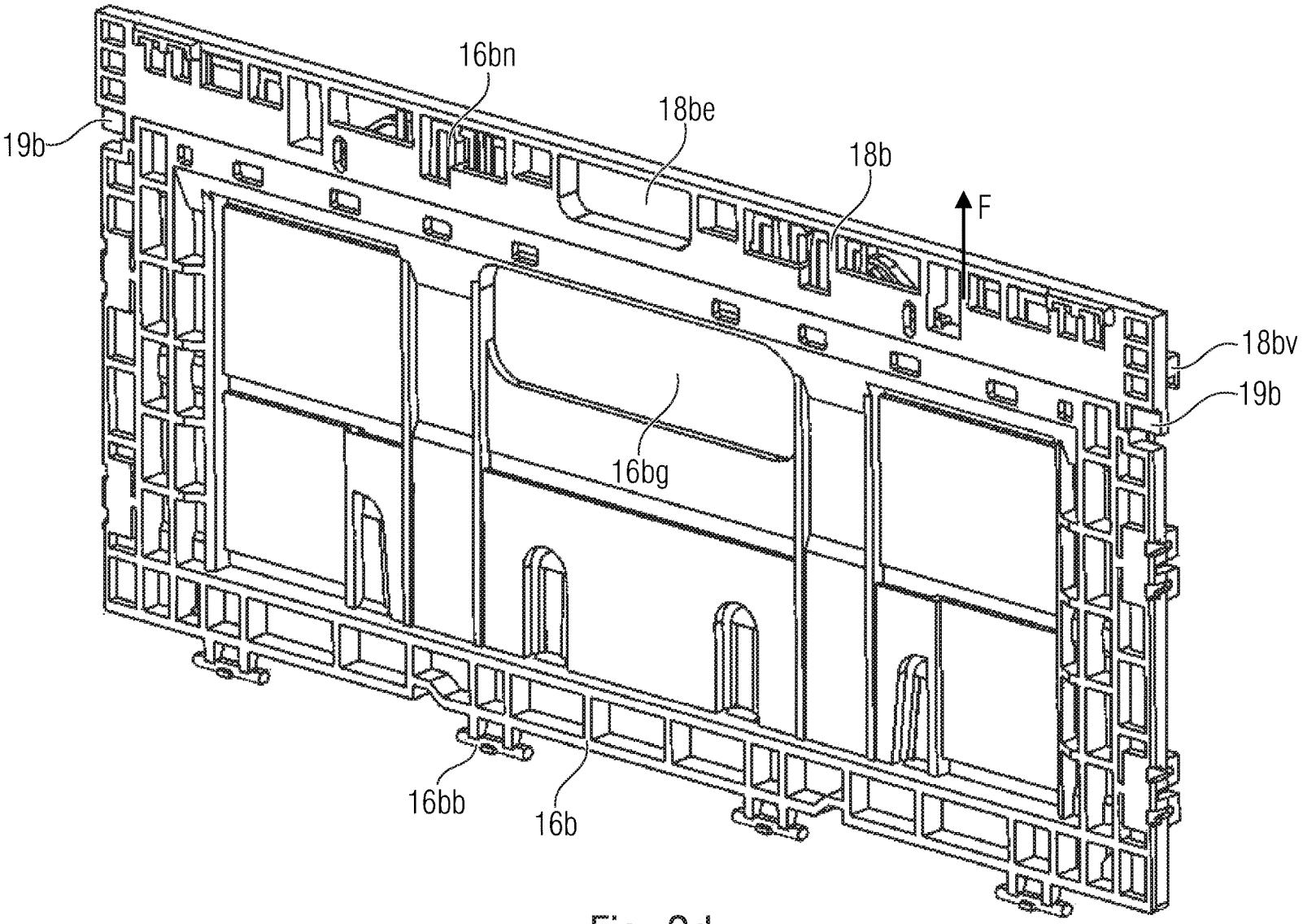
FIG. 2*d* shows a schematic representation of the exterior wall in combination with the lock element from the interior side.

FIG. 2*a* shows the transverse-side exterior wall 16*b* in combination with the associated lock element 18*b* in an assembled representation, whereas FIG. 2*b* shows the same exterior wall in an explanatory representation. FIG. 2*c* depicts the exterior wall 16*b* on its own. In FIG. 2*a*, the exterior wall 16*b* and the lock element 18*b* are depicted from outside, whereas FIGS. 2*b* and 2*c* illustrate an inside view. FIG. 2*d* also shows an interior view of the entire exterior wall 18*b* along with a lock element 18*b*.

As can be seen in FIGS. 2*b* and 2*c*, the lock element 18*a* and 18*b*, which forms the substantial part of the locking mechanism, extends across the entire width of the transverse-side exterior wall 16*b*. At the ends, the lock element 18*b* comprises engagement areas, or snap-in elements 19*b*. They may be formed, e.g., by a projection and/or an extension of the lock element 18*b*. In this embodiment, the two snap-in elements 19*b* comprise a recess, so that they may snap, via said recess, into the associated snap-in hooks (not shown) of the longitudinal-side exterior wall. It shall also be noted at this point that here and in any subsequent explanations it shall be assumed that for each exterior wall, two snap-in elements and, consequently, two snap-in noses are provided, which is not mandatory, however, since the functionality of "securing the folded-open state" may also be implemented for each exterior wall solely by the snap-in elements in combination with the corresponding snap-in nose.

In order to release the locking state (the state wherein the elements 19*b* are engaged with the snap-in hooks/snap-in noses of the longitudinal-side exterior walls) and to form the releasing state, the lock element 18*b* is configured to be displaceable, as was already explained at the outset. Said displaceability is guided by the grooves 16*bn* (cf. FIGS. 2*b*, 2*c* and 2*d*). Said grooves extend along the direction F, i.e., away from the floor in the vertical direction, when one assumes the box to be folded open. As a result of this, the relative movement between the element 18*b* and the element 16*b* is then guided.

As can be seen, in particular, with reference to FIG. 2*d*, the lock element 18*b* comprises an engagement area 18*be* on the interior side, via which the lock element may be actuated. Said engagement area 18*be* is configured as a depression, for example, so that one may engage into same with one's fingers so as to pull the lock element 18*b* in the direction F and to therefore transfer it from the locking state to the releasing state.

In accordance with a further embodiment, the exterior wall 16*b* comprises a handle 16*bg* which enables taking hold of the box 10 in the folded-open state. This handle 16*bg* is formed directly within the element 16*b* and provided with a projection 16*bv*, as may be gathered from FIG. 2*c*, so that said projection 16*bv* (cf. FIG. 2*a*) extends along the lock element 18*b* and surmounts same and/or is configured to be of at least equal thickness, so that during taking hold, there will be no inadvertent displacement of the lock element 18*b* (e.g., in the direction F) and, therefore, no inadvertent actuation of the locking mechanism. To this end, the lock element 18*b* may comprise, e.g., a recess 18*ba* for the handle 16*bg*.

For completeness' sake, it shall also be noted that the transverse-side exterior wall 16*b* includes, on the hinge side (cf. reference numeral 17*b*), hinge bolts 16*bb* which in combination with grooves (not depicted) of the floor plate (not depicted) form the hinge 17*b*. It shall also be noted at this point that this may also be implemented differently. In accordance with a further embodiment, the transverse-side exterior wall comprises a so-called "overlap area" 16*bu* in which the transverse-side exterior wall 16*b* abuts, in the folded-open state, on the respective longitudinal-side exterior wall 14*b*, so that the transverse-side exterior wall 16*b* is prevented from folding out further outward (counter to the direction K). As is depicted in FIG. 1, for example, to this end the longitudinal-side exterior wall 14*a* and/or 14*b* may comprise a projection 14*bv* and 14*av*, respectively, which extends, at the end of the longitudinal-side exterior wall 14*a* and 14*b*, respectively, in the direction of the transverse-side exterior wall. In order to further improve stability of the edge of the box 10, a mortise joint (cf. 16*bv*) may additionally be provided, at the transverse-side exterior wall 16*b*, with associated grooves within the projection 16*bv* and 14*bv*, respectively. The projection 16*bv* and 14*bv*, respectively, in combination with the overlap area allows limiting the movement of the side wall 16*b* in the line of vision of the hinge, while the mortise joint 16*bv*, along with the grooves, restricts movement of the longitudinal-side exterior walls 14*a*, 14*b*.

In accordance with an embodiment, such a mortise-joint element may also be integrated into the lock element 18*b*. Said mortise-joint element is designated by reference numeral 18*bv* and first and foremost performs a function comparable to that of the mortise-joint element 16*bv*. Optionally, the hook element 18*bv*, as depicted here, may also have a hook shape, so that it engages, in addition to the snap-in area 19*b*, into the longitudinal-side sidewall 14*a* and 14*b* or, to be precise, into the projections 14*av* and 14*bv* thereof. In this context, the hook is shaped to enable engagement in the locking state and to enable at least the movement of the side wall 16*b* in the direction K in the releasing state.

Even if all of the additional embodiments which were explained by means of FIGS. 2*a* to 2*d* were illustrated and/or described only in combination with the transverse-side exterior wall 16*b* in combination with the lock element 18*b*, it shall be understood that said optional features may also be implemented in the further transverse-side exterior wall 16*a* and/or in the further lock element 18*b*.

Even if in the above embodiment, mention is usually made of the locking state and releasing state, it shall be noted at this point that the locking state may be both the state of the lock element 18*a*/18*b* in relation to the transverse-side exterior wall 16*a* and 16*b*, which represents the snapped-in state of the four exterior walls 14*a*, 14*b*, 16*a* and 16*b* in the folded-open state of the box 10, and will typically be formed when the foldable box 10 is folded. In contrast thereto, the releasing state is actually the state adopted by the lock element 18*a* and/or 18*b* in relation to the transverse-side exterior wall 16*a* and 16*b* during and/or for snapping-in and during and/or for detachment. In this releasing state, the snap-in elements 19*a* and 19*b* are not engaged with the associated snap-in noses 14*an* and 14*bn*.

With regard to FIGS. 3*a* to 3*b*, additional variants for improving snapping-in and/or detachment shall once again be addressed in detail while the profile of the lock element 18*a* and 18*b* will be explained with reference to FIG. 3*c*. FIG. 3*d* shows a longitudinal-side exterior wall together with a transverse-side exterior wall, which are not engaged with each other.

Figure 3A:
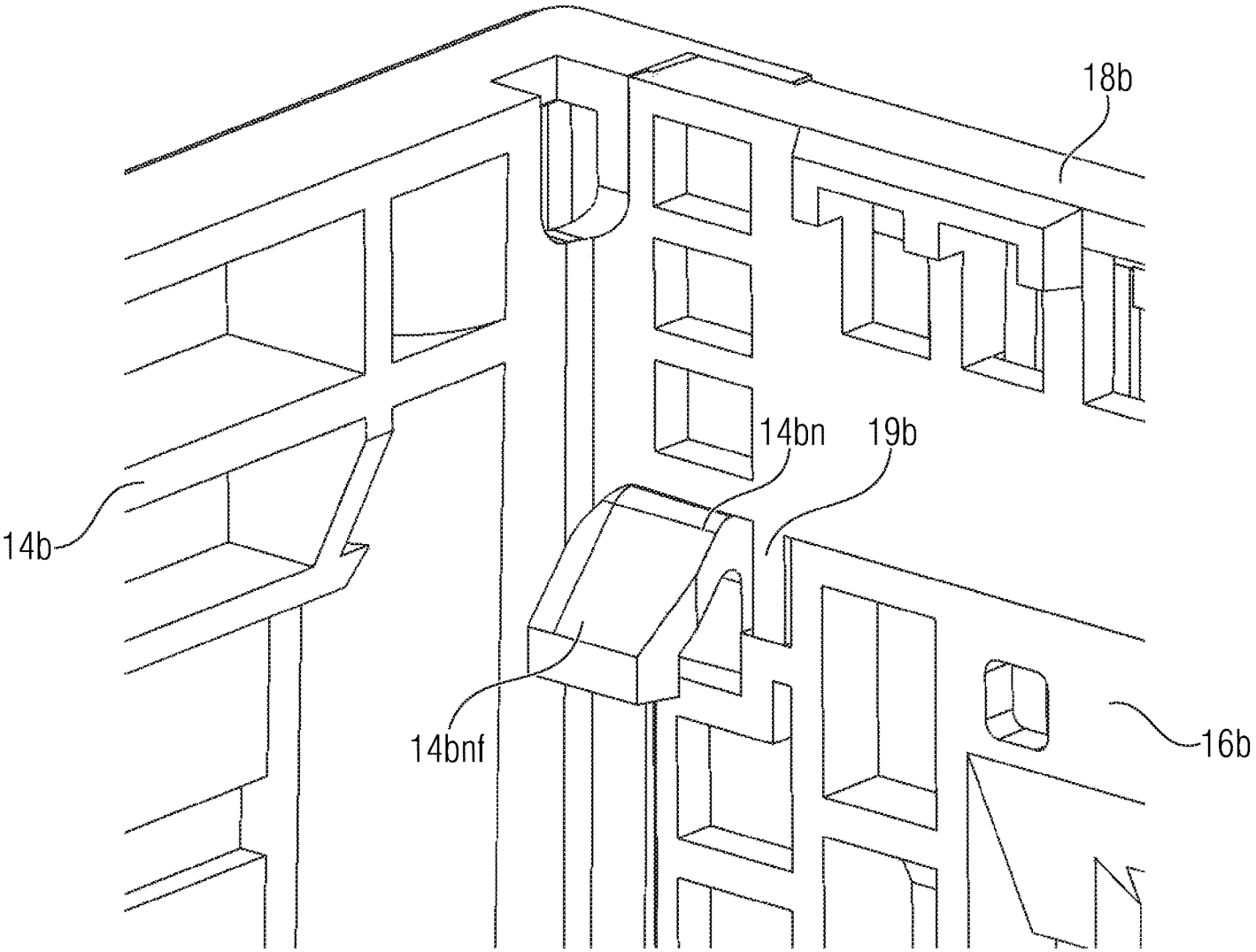
FIGS. 3*a*-3*d* show schematic detailed views for illustrating variation features in accordance with additional embodiments of the foldable box.
Figure 3B:
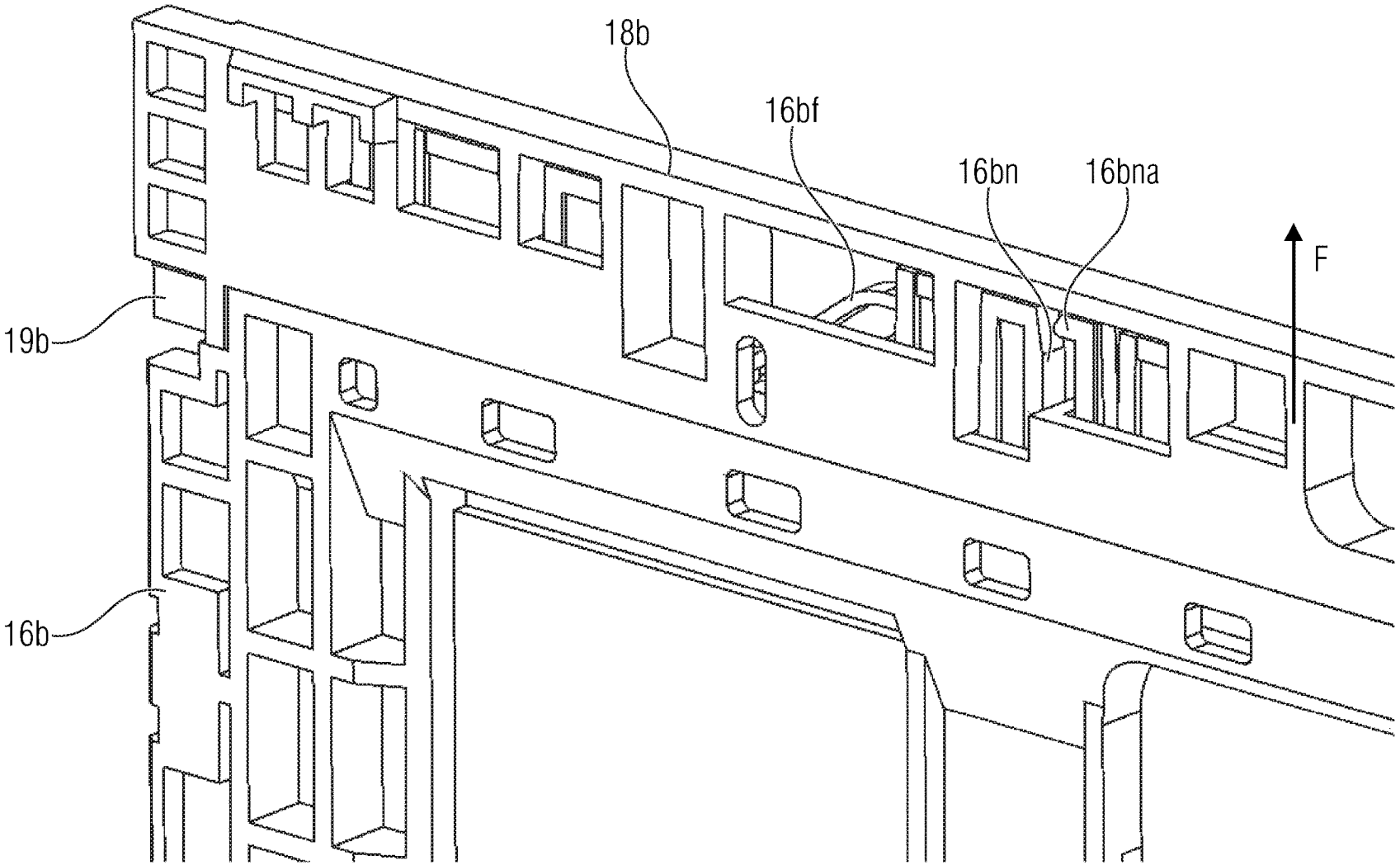

FIG. 3*a* shows the snap-in hook, or the snap-in nose, 14*bn*, which is engaged with the snap-in element 19*b* (behind the snap-in nose, or see FIG. 2*a* and 2*d* or 3*b*). The snap-in nose 14*bn* in this embodiment is arranged on the inside of the projection 14*bv* of the longitudinal-side exterior wall 14*b* and therefore extends at the end of the side wall 14*b* in the direction of the transverse-side exterior wall 16*b*. This becomes clear once again with regard to FIG. 3*d*, which shows the snap-in nose 14*an* of the projection 14*av* as belonging to the longitudinal-side sidewall 14*a*. As can be seen here, the snap-in nose 14*an* (also the snap-in nose 14*bn*) is shaped to have an undercut 14*anh* into which the snap-in element 19*b* may snap in the locking state. The snap-in element 19*b* belongs to the lock element 18*b*, as can also be seen in FIG. 3*b*.

In accordance with one embodiment, the snap-in nose 14*an*, or the snap-in nose 14*bn*, is equipped with a chamfered surface 14*anf* and 14*bnf*, respectively, so that during the outward movement (cf. arrow –K in FIG. 3*b*), the lock element 18*b* is moved from the locking state to the releasing state by means of the snap-in element 19*b* so as to then snap into the undercut 14*anh*. In accordance with an embodiment, said snapping-in is supported by a spring mechanism 16*bf* which may form part of the side wall 16*b*, for example. In this context, reference shall be made to FIGS. 3*b* and 2*c*, which depict said spring mechanism 16*bf*. The spring mechanism is implemented as an elastically deformable cantilever here.

Advantageously, the spring element is integrated into the side wall, which offers advantages with regard to manufacturing and assembly. Alternatively, however, the spring element may just as well be formed by a separate spring or as part of the lock element 18*b*. Irrespective of the specific implementation, the spring mechanism 16*bf* is configured to move the lock element into, or retain it in, the locking position. Accordingly, the spring mechanism may optionally be designed such that there is a constant bias both in the releasing position and in the locking position.

In order to restrict the movement of the lock element 16*b* along the direction F, the groove 16*bn* may comprise one or more stops 16*bna* which, when the end position of the lock element 18*b* in relation to the transverse-side exterior wall 16*b* is reached, prevent further movement in the direction F. By analogy, an end position may also be formed in the opposite direction within said grooves 16*bn*. Alternatively, it would also be feasible for the lock element 18*b* to rest on the free end 16*be* of the exterior wall 16*b*. This version is shown in FIG. 3*c*.

Figure 3C:
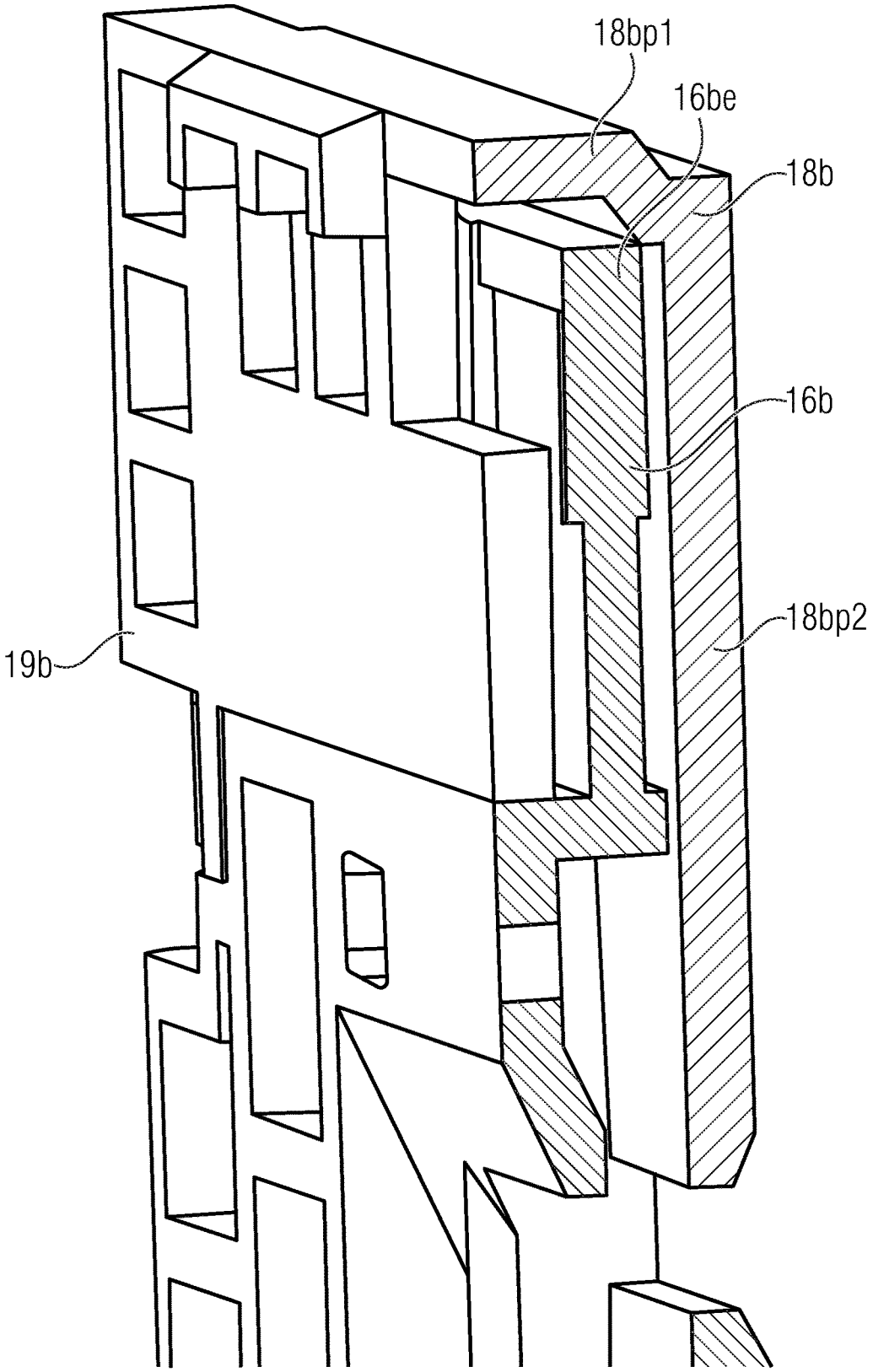
Figure 3D:
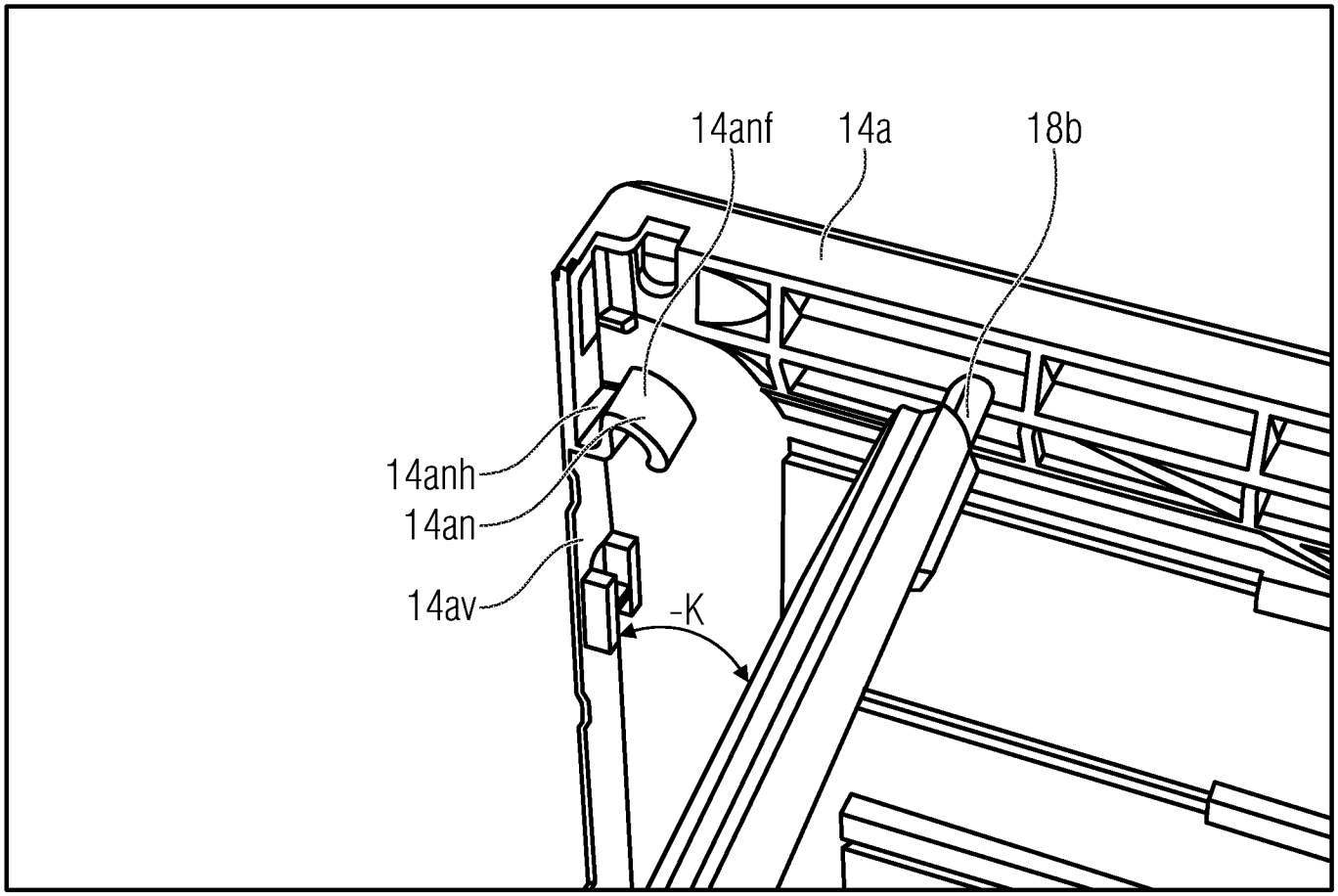

FIG. 3*c* shows the lock element 18*b* in a sectional representation; by means of the profile of the lock element 18*b* one can see that the profile is implemented to be angulated in a planar manner, so that the lock element 18*b* extends, on the one side, in parallel with the transverse-side exterior wall 16*b*, namely on the outside, and also comprises a projection extending beyond the free end 16*b*. Said projection is designated by reference numeral 18*bp*1, whereas that area which extends on the outside of the exterior wall 16*b* is designated by reference numeral 18*bp*2. Because of the projection 18*bp*1, the lock element 18*b* may, in the locking state, rest on the exterior wall 16*b* and, in particular, on the free end of the exterior wall 16*be*. To this end, in accordance with an advantageous variant, the exterior wall 16*b* is configured to be shorter as compared to the exterior walls 14*a* or 14*b*, so that the lock element 18*b* and, in particular, the area 18*bp*1 ends together with the rim 14*ar* and 14*br*, respectively.

It shall be noted once again at this point that the features which have been illustrated here in connection with elements 16*b* and 18*b* may evidently also be transferred to elements 16*a* and 18*a*.

With regard to FIG. 1 it shall be noted that the clearances between the individual slats may also be approximately equal in width so as to imitate a uniform image of a slat structure. In the clearance between the lock element 18*a* and 18*b*, respectively, and the associated side wall 16*a* and 16*b*, respectively, this statement first and foremost relates to the locking state.

Even if in the above embodiments, the improved freedom of design was explained only with reference to a box imitating a wooden-slat structure, it shall be pointed out that other designs, e.g., a completely closed design, may also be implemented, of course.

With reference to FIG. 1 it shall further be noted that the box 10 may comprise not only the handles 16*bg* and 16*ag*, respectively, on the transverse-side exterior walls 16*b* and 16*a*, but may also comprise the handles on the longitudinal-side exterior walls.

In addition, it shall be noted that the box 10 may be configured, e.g., by means of an elevated hinge area 15*a* and 15*b* in the floor 12, such that the longitudinal-side exterior walls 14*a* and 14*b* may be folded onto the transverse-side exterior walls 16*a* and 16*b*. This influences the heights of the individual parts.

As was explained above, one advantageous variant is to configure the lock element 18*a*/18*b* in one piece, i.e., as one transverse strut with integrated snap-in elements 19*a*/19*b*. Alternatively, the lock element 18*a*/18*b* may also be configured in several pieces, e.g., as a profile (L or U shape) produced by means of a sandwich design.

It shall be noted at this point that the above embodiments serve only to illustrate the technical teaching and shall not restrict the scope. Said scope will be defined by the claims inserted below.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Foldable box comprising a rim and comprising:

a floor; and two longitudinal-side and transverse-side exterior walls which are foldable in relation to the floor and are located opposite one another in pairs, respectively, and two lock elements comprising integrated rim areas;

wherein the longitudinal-side and transverse-side exterior walls each comprise a hinge and a free end located opposite the hinge, the two longitudinal-side exterior walls each forming a rim area along the free end;

wherein the two lock elements are arranged at the free ends of the transverse-side exterior walls such that the integrated rim areas of the two lock elements and the two rim areas of the longitudinal-side exterior walls form the rim in the folded-open state of the foldable box;

wherein the two lock elements are mounted to be moveable in relation to the transverse-side exterior walls to form a locking mechanism, wherein the two lock elements may be transferred from a respective locking state to a releasing state by a movement in a direction away from the floor.

2. Foldable box as claimed in claim 1, wherein the two lock elements extend beyond the respective free end of the transverse-side exterior wall.

3. Foldable box as claimed in claim 1, wherein the two lock elements are configured to be angulated, in cross-section, at least in one or more portions, and rest on the respective free end of the transverse-side exterior walls.

4. Foldable box as claimed in claim 1, wherein the two lock elements exhibit an L profile at least in one or more portions.

5. Foldable box as claimed in claim 1, wherein the two lock elements exhibit a U profile at least in one or more portions.

6. Foldable box as claimed in claim 1, wherein the movement of the two lock elements extends in a direction that is vertical with regard to the surface of the floor during transferal from the respective locking state to the releasing state in the folded-open state.

7. Foldable box as claimed in claim 6, wherein the two lock elements are spring-mounted in relation to the transverse-side exterior walls by means of a respective spring mechanism, the spring mechanism being configured to move the lock element into the locking state, and/or to retain it therein, by means of the spring force of the spring mechanism.

8. Foldable box as claimed in claim 7, wherein the respective spring mechanism is configured as a spring integrated into the transverse-side exterior wall.

9. Foldable box as claimed in claim 1, wherein the two lock elements are configured in one piece and extend across the entire width of the transverse-side exterior wall.

10. Foldable box as claimed in claim 1, wherein the oppositely located longitudinal-side and transverse-side exterior walls imitate a slat structure and/or a wooden-slat structure extending along the free end; and/or wherein the two lock elements of the transverse-side exterior walls each imitate a slat of the slat structure or wooden-slat structure; and/or wherein the two rim areas of the longitudinal-side exterior walls each imitate a slat of the slat structure or wooden-slat structure; and/or wherein the slats formed by the two lock elements as well as the two slats formed by the two rim areas are essentially equal in height.

11. Foldable box as claimed in claim 1, wherein each of the longitudinal-side exterior walls comprises, at least one transverse-side end, a projection which extends, in the folded-open state, in the direction of the transverse-side exterior walls and which restricts foldability of the transverse-side exterior walls toward the outside.

12. Foldable box as claimed in claim 1, wherein each of the longitudinal-side exterior walls comprises, at least one transverse-side end, a snap-in hook which extends in the direction of the transverse-side exterior walls; and/or wherein the two lock elements each comprise at least one snap-in element which extends in the direction of the longitudinal-side exterior walls in the folded-open state; and/or wherein the at least one snap-in element is configured to be engaged with the at least one snap-in hook so as to form the locking state.

13. Foldable box as claimed in claim 12, wherein the snap-in hook comprises an inwardly directed first contact surface which is angulated, so that the snap-in element transfers, during outward movement of the transverse-side exterior wall, the lock element from a locking state to a releasing state so as to snap into the snap-in hook.

14. Foldable box as claimed in claim 12, wherein the two lock elements are spring-mounted and/or biased in relation to the transverse-side exterior walls by means of a respective spring mechanism, so that the movement from the locking state to the releasing state is effected counter to the spring force.

15. Foldable box as claimed in claim 1, wherein each transverse-side exterior wall comprises one or more guide grooves extending vertically along the transverse-side exterior wall in the folded-open state, which guide grooves guide therein the respective lock element in its movement in relation to the transverse-side exterior wall; and/or wherein at least one of the guide grooves has one or more end stops provided therein which limit/restrict movement of the lock elements along the vertical direction at one or more end positions.

16. Foldable box as claimed in claim 1, wherein the longitudinal-side exterior walls extend to be higher than the transverse-side exterior walls in a direction that is vertical with regard to the surface of the floor.

17. Foldable box as claimed in claim 1, wherein each of the lock elements comprises a manually actuable grip area and via which the locking mechanism may be actuated, said manually actuable grip area being formed as an interior recess or projection.

18. Foldable box as claimed in claim 1, wherein each respective lock element of the two lock elements is configured in one piece.

19. Foldable box as claimed in claim 1, wherein each of the transverse-side exterior walls comprises a handle which comprises a projection extending along the associated lock element.

* * * * *